United States Patent [19]

Saito

[11] 4,317,706

[45] Mar. 2, 1982

[54] APPARATUS FOR PLATING A PRINTING ROLLER

[75] Inventor: Susumu Saito, Kashiwa, Japan

[73] Assignee: Shinku Laboratory Co., Ltd., Chiba, Japan

[21] Appl. No.: 167,107

[22] Filed: Jul. 9, 1980

[51] Int. Cl.[3] ..... C25D 17/00; C25D 17/02; C25D 3/00

[52] U.S. Cl. ..... 204/198; 204/25; 204/2

[58] Field of Search ..... 204/25, 198, 212–218

[56] References Cited

U.S. PATENT DOCUMENTS

| | | | |
|---|---|---|---|
| Re. 19,560 | 5/1935 | Hannon | 204/214 X |
| 3,244,613 | 4/1966 | Karlquist | 204/297 |
| 3,462,357 | 8/1969 | Karlquist | 204/197 |
| 3,607,712 | 9/1971 | Barton et al. | 204/202 |
| 3,660,265 | 5/1972 | Kangas | 204/212 |
| 3,664,944 | 5/1972 | Buckley | 204/212 |
| 3,674,673 | 7/1972 | Jessup | 204/213 |

*Primary Examiner*—F. Edmundson
*Attorney, Agent, or Firm*—Koda and Androlia

[57] ABSTRACT

An apparatus for plating an outer circumferential surface of a hollow roller of the type including a plating tank and an additional working station such as a pretreatment tank, after-treatment tank or mounting and dismounting board. The apparatus further includes a swing arm swingable between the additional working station and the plating tank and a means for automatically mounting and dismounting the roller provided on an end of the swing arm. The mounting and dismounting means includes a pair of spindles facing each other and rotatably and slidably coupled to the swing arms such that the spindles can be rotated and axially moved, a pair of charge carriers provided on the spindle for supporting the roller at both ends and liquid leakage prevention caps provided around the spindles and movable in an axially direction for engagement with and disengagement from the ends of the roller for preventing leakage of a process solution to an inside surface of the roller.

4 Claims, 2 Drawing Figures

APPARATUS FOR PLATING A PRINTING ROLLER

BACKGROUND OF THE INVENTION

1. Field of the Invention

This invention relates to apparatuses for plating a roller and more particularly to apparatuses for automatically plating a gravure roller.

2. Prior Art

In order to provide homogeneous plating of a gravure roller, at least a part of the roller surface must be immersed in a process solution and the roller must be rotated with precision at a specified constant rate. In addition, in order to carry out the plating in a short time period, it is desireable to immerse the whole body of the roller in the process solution. Consequently, because the gravure roller is hollow in shape, some action must be taken to prevent the process solution from leaking to the inside of the roller.

With such a necessity, in conventional plating processes for gravure plate making, action is taken as follows: a spindle is inserted through the hollow gravure roller; both ends of the roller are supported with a pair of ring shaped charge-supporters provided on the spindle; ring shaped leakproof caps are provided on the spindle to cover both of the charger-supporters and seal the ends of the roller; and the completed set-up is then mounted on a pretreatment apparatus, then mounted on plating apparatus, and then mounted on an after-treatment apparatus. However, in such a procedure, a manual mounting is indispensable, and complete automatization has been hindered. Also, in such a process a great amount of man power is required and work efficiency is low.

In addition, in another conventional example, the Europena gravure plate maker is equipped with an apparatus to automatically mount the gravure roller onto the pretreatment apparatus, plating apparatus, and after-treatment apparatus or to dismount the roller from each of them respectively as well as to rotate the roller. However, such a structure has certain disadvantages as is described below. Firstly, the cost is high because an automatic mounting apparatus is required for each pretreatment, plating and after-treatment apparatus. In addition, the mounting must be done on each apparatus and therefore the time required for the process increases. In addition, since there are required a great number of mounting and dismountings of the roller, the chance of a leak into the inside of the roller is increased. Furthermore, because the roller is directly lifted onto and off of each one of the apparatuses, there is a substantial possibility that the roller surface will be scratched and to avoid such scratching the rollers must be handled carefully and with a soft material such as a cloth.

SUMMARY OF THE INVENTION

Accordingly, it is the general object of the present invention to provide an apparatus for plating a roller wherein the roller can be conveyed from the plating tank to a pretreatment tank, after-treatment or mounting/dismounting board without mounting and dismounting the roller.

It is another object of the present invention to substantially reduce the number of mounting and dismounting apparatuses required for the plating process.

It is still another object of the present invention to provide an apparatus for plating which substantially reduces the cost of equipment.

In keeping with the principles of the present invention, the objects are accomplished by a unique apparatus for plating an outer circumferential surface of a hollow roller of the type including an additional station such as a pretreatment tank, after-treatment tank or mounting and dismounting board for mounting and dismounting the roller in addition to a plating tank. The apparatus includes a swing arm swingable between the additional working station and the plating tank and a means for automatically mounting and dismounting the roller provided on an end of the swing arm. The means includes a pair of spindles facing each other and rotatably and slidably coupled to the swing arm such that the spindles can be rotated and axially moved, a pair of charge carriers provided on the spindle for supporting the roller at both ends and liquid leakage prevention caps provided around the spindles and movable in an axial direction for engagement with and disengagement from the ends of the roller for preventing leakage of a process solution to an inside surface of the roller.

BRIEF DESCRIPTION OF THE DRAWINGS

The above-mentioned features and objects of the present invention will become more apparent with references to the following description taken in conjunction with the accompanying drawings, wherein like reference numerals denote like elements and in which.

DETAILED DESCRIPTION OF THE INVENTION

Figure 1:
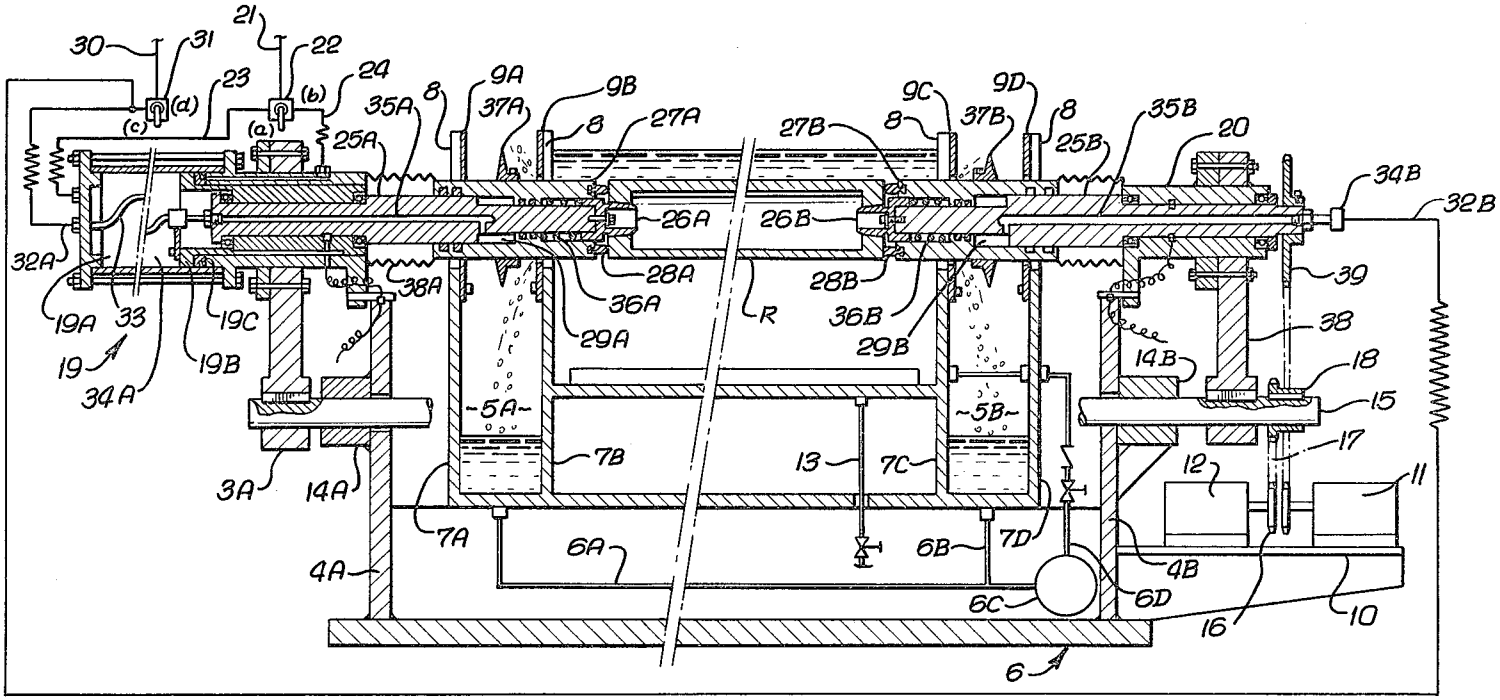
FIG. 1 is a front view of an apparatus for plating the outer circumferential surface of a hollow roller, in accordance with the teachings of the present invention.
Figure 2:
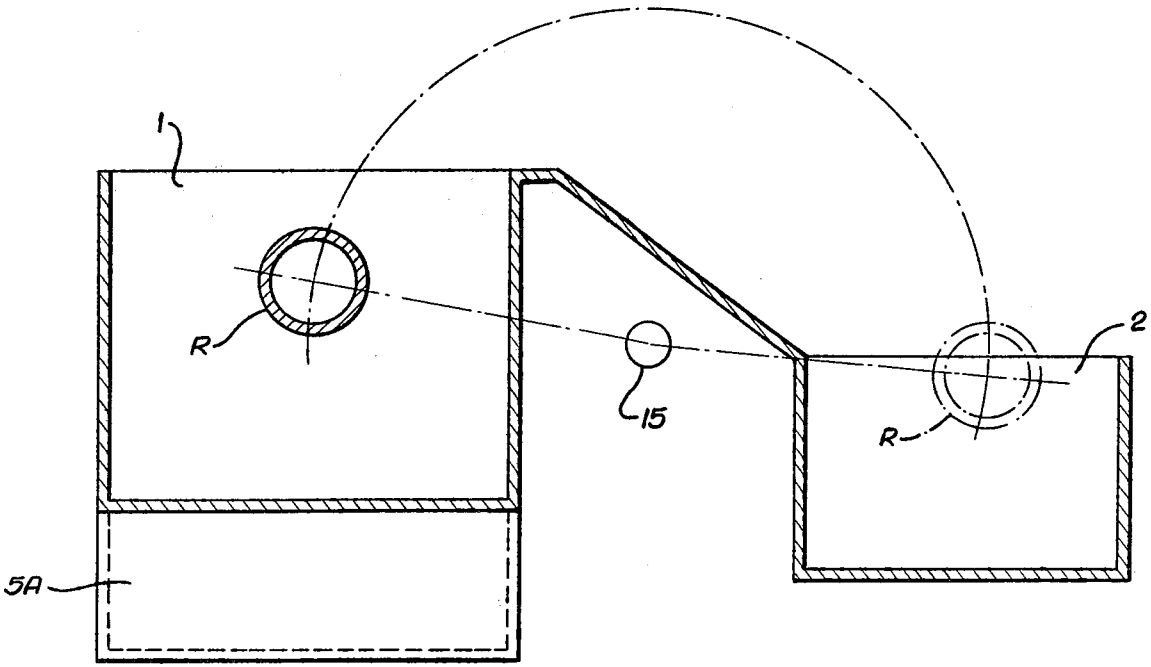
FIG. 2 is schematic section illustrating the general operation of a plating apparatus, in accordance with the teachings of the present invention.

Referring to FIG. 1, shown therein is an apparatus in accordance with the teachings of the present invention which consists of a lower plating apparatus and an upper mounting apparatus. The lower plating apparatus includes a pretreatment tank 2 provided in addition to a plating tank 1 and a pair of swing arms 3A and 3B which are freely swingable between the pretreatment tank 2 and the plating tank 1. The mounting apparatus is provided at the end of the swing arms 3A and 3B and the mounting apparatus is capable of carrying the roller R held by the mounting apparatus at both ends from the plating tank 1 to the pretreatment tank 2.

Particularly referring to the plating apparatus, the plating apparatus includes a pair of right and left frames 4A and 4B for mounting the mounting apparatus at a set position and between the frames 4A and 4B is mounted the plating tank 1 and the pretreatment tank 2. On both sides of the plating tank 1 are provided recovery tanks 5A and 5B. Circulator 6, which consists of pipes 6A and 6B, circulation pump 6C and circulation pipe 6D, connect the recovery tanks 5A and 5B with the plating tank 1. Four side panels 7A, 7B, 7C and 7D constitute the tanks 1, 5A and 5B. Notches 8 are provided on the panels 7A–7D so that the mounting apparatus can be fitted into them. In order to minimize the leakage of the process solution from the plating tank 1 through the notches 8 as well as to completely prevent the process solution from leaking to the outside of the recovery tank, leak prevention plates 9A, 9B, 9C and 9D, capable of sealing the respective notches 8 are provided. These respective prevention plates 9A through 9D are formed with a split so as to open to the right and left and the lower ends of the respective split elements are pivoted to the side panels 7A through 7D. These leak prevention plates 9A through 9D are designed to usually be open wide to the right and left at their upper portions by means of springs, not shown in the drawings, but to seal the notches 8 when the mounting apparatus is fitted in due to the weight of the mounting apparatus on the leak prevention plates 9A through 9D. Also, in the same manner, similar notches, not shown in the drawings, are provided in the two side panels constituting the pretreatment tank 2 so that the mounting apparatus can be fitted in.

On the accessory board 10 attached to the frame 4B, an appropriate chain gear drive unit is provided which is equipped with two motors 11 and 12. Under the plating tank 1 is provided a drip trap 13. Also a pair of swing arms 3A and 3B are respectively fastened to the projecting out ends of both sides of the arm driving shaft 15 inserted through bearings 14A and 14B provided on the frames 4A and 4B, respectively. The swing arms 3A and 3B are swiveled from the pretreatment tank to the plating tank by a preset number of rotations of the motor 12 on the accessory board 10 through a drive transmission which includes the primary sprocket 16 provided on the motor 12, a secondary sprocket 18 provided on the arm driving shaft and a chain 17 connecting the primary sprocket 16 and secondary sprocket 18 together.

The above described mounting apparatus is provided at the end of the pair of swing arms 3A and 3B. The mounting apparatus includes an air cylinder unit 19 installed on the left swing arm 3A and the cylinder bearing box 20 is installed on the right swing arm 3B. The air cylinder unit 19 is capable of pushing the piston 19B made of non-electrically conductive material along a direction to the right of swing arm 3B by conducting the high pressure air in the high pressure tank (not shown in the drawings) to push out side cylinder chamber 19A through pipe 21, switching valve 22 and the pipe 23. Also, by conducting high pressure air to the retreating side cylinder chamber 19C through the pipe 24 by switching the switching valve from (a) to (b) position, the piston 19B can be pulled back. To this piston 19B and the bearing box 20, spindles 25A and 25B are rotatably provided facing each other. At the ends of the respective spindles 25A and 25B are provided charger-supporters 26A and 26B which include tapered, cylindrical portions functioning to anchor and support the roller R. On the outside of the respective spindles 25A and 25B are provided leakproof caps 27A and 27B made of non-electroconductive material. The leakproof caps 27A and 27B are provided on the spindles 25A and 25B such that they are slidable along the axis of the spindles. On the front the leakproof caps 27A and 27B are provided ring shaped packings 28A and 28B which engage with the ends of the roller R. To operate the right and left leakproof caps 27A and 27B, cylinder members 29A and 29B are formed by stepped inner surfaces of the leakproof caps 27A and 27B and stepped portions on the spindles 25A and 25B. Into the cylinder chamber 29A on the left, high pressure air from the high pressure tank is lead through a pipe 30, switching valve 31, pipe 32A, flexible pipe 33 provided in the cylinder chamber 19A, rotary joint 34A and air inlet 35A provided in the spindle 25A. High pressure air is provided to the right cylinder chamber 29B through the pipe 32B, rotary joint 34B and air inlet 35B provided in the spindle 25B. By such a construction, the respective leakproof caps 27A and 27B can be moved towards each other. Also, the respective leakproof caps 27A and 27B are designed to return to their original position by the action of the springs 36A and 36B inserted in the coil form formed between the leakproof caps 27A and 27B and the respective small diameter portions of the corresponding spindles 25A and 25B, when the switching valve 31 is switched from position (d) to (c).

The process solution of the plating tank 1, which leaks from the notches 8, drops into the recovery tanks 5A and 5B, and is preventing from running down the spindles 25A and 25B by the drain boards 37A and 37B. In order to utilize the charger-supporters 26A and 26B, electrical connection is provided to the bearing parts of the respective spindles 25A and 25B. The right spindle 25B is designed to let the sprocket 39 installed at its face interlock with an appropriate chain transmission gear, which is driven by the motor 11 of the board 10. Furthermore, the chain transmission gear is designed to interlock with the sprocket 39 when the sprocket 39 is moved to a position corresponding to either the plating tank 1 or the pretreatment tank 2 by the action of the swing arms 3A and 3B.

In operation, in order to support the roller R at its both ends by the pair of charger-supporters 26A and 26B, the following procedures first occur. First, the right end of the roller R is inserted onto the right charger-supporter 26B. Then, by changing the lever of the switching valve 22 from position (b) to (a), the piston 19B is pushed out by the air pressure in the air cylinder unit 19 to cause the left charge-supporter 26A on the left spindle 25A to fit into the tapered opening at the left end of the roller R. When the roller R is supported at both ends by the charger-supporters 26A and 26B, the roller carrier is removed.

The lever of the switching valve 31 is then shifted from the position (b) to (c). As a result, high pressure air in the high pressure tank is led into the right and left cylinder chambers 29A and 29B and the mutually approaching right and left leakproof caps 27A and 27B come into contact with both end surfaces of the roller R and thus securely prevents process solution from leaking inside of the roller R. After the roller is supported at both ends in this manner, the motor 11 is actuated to drive the roller. When the motor 11 is actuated, the left spindle 25B starts to rotate and the roller R which is rotated at a constant rate by the rotation of the spindle is processed with pretreatment (nickel plating and treatment). When the pretreatment is completed the motor 11 is stopped and the motor 12 is actuated. The motor 12 rotates for a specified number of turns to swing the swing arms 3A and 3B from the pretreatment tank 2 to a position corresponding with the plating tank 1 and carries the roller R supported at its both ends by the mounting apparatus to the plating tank 1. Thereafter, when the motor 11 is actuated, the roller R is again rotated at a specified rate. Also, when the circulation pump 6C is started, the liquid level of the process solution in the plating tank will recover to its required height. Furthermore, an electric current is fed by appropriate control to the roller to cause plating. The plating tank 1 becomes the positive electrode and the roller R becomes a negative electrode via the right and left charger-supporters 26A and 26B. When the plating of the roller is completed in this manner, the current to the electrode is cut off and the circulation pump 6C and the motor 11 is stopped. The motor 12 is then driven in the reverse direction. By operation of the motor 12, the swing arms 3A and 3B are swiveled from the plating tank 1 to the position corresponding to pretreatment tank 2, the roller R is carried to the pretreatment tank 2 by the mounting apparatus. Then, after securely mounting the roller R in a carrier, the switching valve 31 is turned from the position (c) to (d) and the switching valve 22 is turned from the position (a) to (b). As a result, the piston 19B of the air cylinder unit 19 retreats, the leakproof caps 27A 27B separate from each other and the mounting apparatus releases both ends of the roller from its grasp. Thereafter, by repeating the above described process, the next roller is mounted in the mounting apparatus and processed with pretreatment and plating.

It should be apparent that the mounting and dismounting of the roller R may be performed in the plating tank 1 with the liquid level of the process solution lowered. Needless to say, in a structure utilizing a mounting board combined with the plating tank instead of a pretreatment tank 2, the mounting or dismounting of the roller can be carried out on the mounting board. Furthermore, it should be apparent that the operation of the spindles is not limited to only those operated by air and various other driving devices such as rack combined with a spindle, a pinion driven by a motor or hydraulic means could be utilized. Furthermore, the driving devices may also be installed in the plating apparatus and the driving gear to rotate the spindle does not necessarily have to be provided on the mounting apparatus.

In addition, while the present invention discusses the use of a pretreatment tank, the pretreatment tank could be replaced by an after-treatment tank or a mounting-/dismounting board.

It should be apparent to those skilled in the art that the above described embodiment is merely one of the many possible specific embodiments which represent the applications and principles of the present invention. Numerous and various other arrangements can be readily devised by those skilled in the art without departing from the spirit and scope of the present invention.

I claim:

1. An apparatus for plating an outer circumferential surface of a hollow roller of the type including a plating tank and an additional work station such as a pretreatment tank, after treatment tank or mounting and dismounting board, said apparatus comprising:

a pair of swing arms swingable between the additional work station and the plating tank;

a means for swinging said swing arms from said additional work station to said plating tank and back to said additional work station;

a means for automatically mounting and dismounting the roller provided on ends of the swing arms, said means comprising:

a first spindle rotatably and slidably coupled to one of the swing arms such that the first spindle can be rotated and axially moved;

a second spindle facing said first spindle and rotatably coupled to another one of said swing arms such that said second spindle can be rotated;

a pair of charge carriers provided on the spindle for supporting the roller at both ends and for providing an electrical connection to both ends of said roller;

liquid leakage prevention caps provided around the charge carriers facing each other and movable in an axial direction for engagement with and disengagement from the ends of the roller for preventing the leakage of a process solution to the inside surface of the roller;

a means for axially moving said first spindle;

a means for rotating said second spindle; and a means for axially moving said liquid leakage prevention caps; and a pair of notches provided in opposite sides of said plating tank whereby said means for automatically mounting and dismounting the roller can be fitted into said plating tank; and a pair of leak prevention plate provided on each of said notches, each of said leak prevention plates being arranged and configured such that said pair of notches are sealed when said means for automatically mounting and dismounting the roller is fitted into said plating tank whereby the plating liquid level in the plating tank can be set higher than an upper surface of said roller.

2. A plating apparatus according to claim 1, wherein said means for axially moving said spindles and said liquid leakage prevention caps is operated by air pressure.

3. A plating apparatus according to claim 2, wherein said means for swinging said swing arm and said means for rotating said spindles comprise electric motors.

4. A plating apparatus according to claim 3, wherein said liquid leakage prevention caps comprise electrically nonconductive packings.

* * * * *